US010906336B2

(12) United States Patent
Kakimoto et al.

(10) Patent No.: US 10,906,336 B2
(45) Date of Patent: Feb. 2, 2021

(54) TRANSPORT APPARATUS, AND A PRINTING APPARATUS HAVING SAME

(71) Applicant: SCREEN HOLDINGS CO., LTD., Kyoto (JP)

(72) Inventors: Shoji Kakimoto, Kyoto (JP); Osamu Morizono, Kyoto (JP); Katsuaki Takeuchi, Kyoto (JP)

(73) Assignee: SCREEN HOLDINGS CO., LTD., Kyoto (JP)

( * ) Notice: Subject to any disclaimer, the term of this patent is extended or adjusted under 35 U.S.C. 154(b) by 77 days.

(21) Appl. No.: 15/377,566

(22) Filed: Dec. 13, 2016

(65) Prior Publication Data

US 2017/0165986 A1 Jun. 15, 2017

(30) Foreign Application Priority Data

Dec. 15, 2015 (JP) ..... 2015-244277

(51) Int. Cl.

| | |
|---|---|
| ***B65H 23/00*** | (2006.01) |
| ***B41J 15/16*** | (2006.01) |
| ***B41J 13/00*** | (2006.01) |
| ***B41J 2/01*** | (2006.01) |

(52) U.S. Cl.

CPC ..... *B41J 13/0009* (2013.01); *B41J 2/01* (2013.01); *B41J 15/16* (2013.01); *B65H 23/00* (2013.01)

(58) Field of Classification Search

None

See application file for complete search history.

(56) References Cited

U.S. PATENT DOCUMENTS

| | | | | |
|---|---|---|---|---|
| 4,089,196 | A * | 5/1978 | Kondo | B21B 37/48 72/10.4 |
| 5,240,194 | A * | 8/1993 | Noirot | B21C 47/003 226/24 |
| 6,211,968 | B1 * | 4/2001 | Glockner | B65H 23/188 358/1.12 |
| 9,033,200 | B2 * | 5/2015 | de Jong | B41J 11/42 226/111 |
| 2004/0118892 | A1 * | 6/2004 | Weber | A61F 13/15772 226/44 |
| 2013/0257963 | A1 * | 10/2013 | Yamamoto | B41J 13/0009 347/16 |

FOREIGN PATENT DOCUMENTS

JP 2014-024266 A 2/2014

* cited by examiner

*Primary Examiner* — Alejandro Valencia
(74) *Attorney, Agent, or Firm* — McDermott Will & Emery LLP

(57) ABSTRACT

An upstream drive roller transports an elongate medium. An upstream tension sensor detects tension of the medium. A downstream drive roller transports the medium. A downstream tension sensor detects tension of the medium in a position between the upstream and downstream drive rollers. A control unit controls transportation of the medium by operating the upstream drive roller based on a first difference which is a difference between a first detection value and a target value, operating the downstream drive roller based on a second difference which is a difference between a second detection value and a target value, and when a specific condition is satisfied, further operating the downstream driver roller with an adjustment value, which is based on the first difference, added to the second difference.

18 Claims, 9 Drawing Sheets

CONVENTIONAL EXAMPLE

CONVENTIONAL EXAMPLE

TRANSPORT APPARATUS, AND A PRINTING APPARATUS HAVING SAME

BACKGROUND OF THE INVENTION

(1) Field of the Invention

This invention relates to a transport apparatus for transporting an elongate medium in a predetermined direction, and a printing apparatus having the same.

(2) Description of the Related Art

Conventionally, a printing apparatus having this type of transport apparatus includes a paper feeder, a printing station, a takeup roller and a transport apparatus (see Japanese Unexamined Patent Publication No. 2014-24266 (FIG. 1), for example).

The transport apparatus includes a first drive roller with a nip roller disposed downstream of the paper feeder, which supplies elongate printing paper, for feeding the printing paper from the paper feeder, a second drive roller with a nip roller for feeding into the printing station the printing paper sent by this first drive roller, a third drive roller (also called a heat roller) for winding the printing paper at a large winding angle, and drying and sending forth the printing paper, and a fourth drive roller with a nip roller for sending the printing paper dried by the third drive roller on to the takeup roller. The transport apparatus further includes a first tension sensor for measuring the tension of the printing paper sent from the first drive roller, a second tension sensor for measuring, in a position upstream of the printing station, the tension of the printing paper sent from the second drive roller, and a third tension sensor for measuring the tension in a position upstream of the fourth drive roller.

This transport apparatus has a controller for controlling transportation of the printing paper by operating the first drive roller based on a difference between a target value of the tension which should be applied to the printing paper with the first drive roller and a detection value by the first tension sensor, operating the third drive roller based on a difference between a target value of the tension which should be applied to the printing paper with the third drive roller and a detection value by the second tension sensor, and operating the fourth drive roller based on a difference between a target value of the tension which should be applied to the printing paper with the fourth drive roller and a detection value by the third tension sensor.

However, the conventional example with such construction has the following problem.

With the conventional apparatus, depending on printing paper, slipping due to an insufficient carrying force may occur on the third drive roller for which no nip roller is provided in order to prevent scumming by ink transfer. As a result, the detection value of the second tension sensor may not reach the target value. Then, since the tension in print areas of the printing paper on which printing is made at the printing station does not reach the predetermined value, there arises a problem of low print quality. Because the tension measured by the second tension sensor does not reach the target value, the rotating speed of the third drive roller is increased to raise the tension applied to the printing paper. But since the printing paper does not follow this effort because of the shortage of carrying force, there may arise a problem that the printing paper is scarred which leads to damage.

SUMMARY OF THE INVENTION

This invention has been made having regard to the state of the art noted above, and its object is to provide a transport apparatus with a devised control of drive rollers to be able to improve print quality on a printing medium and prevent damage to the printing medium, and to provide a printing apparatus having such a transport apparatus.

The above object is fulfilled, according to this invention, by A transport apparatus for transporting an elongate medium in a redetermined direction, comprising: an upstream drive roller for transporting the medium; an upstream tension sensor for detecting tension of the medium in a position upstream in the predetermined direction of the upstream drive roller; a downstream drive roller for transporting the medium in a position downstream in the predetermined direction of the upstream drive roller; a downstream tension sensor for detecting tension of the medium in a position between the upstream drive roller and the downstream drive roller; and a control unit for controlling transportation of the medium by operating the upstream drive roller based on a first difference which is a difference between a first detection value obtained from the upstream tension sensor and a target value of tension which should be applied to the medium, operating the downstream drive roller based on a second difference which is a difference between a second detection value obtained from the downstream tension sensor and a target value of tension which should be applied to the medium, and when a specific condition is satisfied, further operating the downstream drive roller with an adjustment value, which is based on the first difference, added to the second difference.

According to this embodiment, the control unit operates the upstream drive roller based on the first difference, and the downstream drive roller based on the second difference. When the specific condition is satisfied, the control unit operates the downstream drive roller with the adjustment value, which is based on the first difference, added to the second difference. Therefore, a shortage of tension upstream in the predetermined direction of the upstream drive roller is compensated for with an increase by the adjustment value of the control amount for the downstream drive roller. As a result, the tension upstream in the predetermined direction of the upstream drive roller can be made proper, and print quality for the medium can be improved. Since the first detection value can be brought close to the target value, it can prevent an increase in rotating speed of the upstream drive roller in an effort to continue raising the tension applied to the medium, thereby to inhibit damage to the medium caused by the upstream drive roller.

In this invention, it is preferred that the control unit checks whether the specific condition is satisfied, after a transport speed of the medium has become constant.

The transport speed and tension are unstable in a state where transportation of the medium has just begun, or where transportation of the medium begins to be stopped. In such a state, whether the specific condition is satisfied cannot be determined accurately. It is therefore possible to determine accurately after the transport speed of the medium has become constant that the specific condition is satisfied. This allows an appropriate execution of the operation of the downstream drive roller with the adjustment value added.

In this invention, it is preferred that the control unit checks whether the specific condition is satisfied, each time a transport distance of the medium attains a predetermined distance.

The transportation of the medium may become unstable when the control unit frequently checks whether the specific condition is satisfied, and frequently performs the control of the downstream drive roller to which the adjustment value is added. The medium can be transported stably by doing the checking each time the predetermined distance is attained. This can also lighten the load on the control unit.

In this invention, the specific condition may comprise a state where the first difference is equal to or larger than a first threshold.

The operation to add the adjustment value is not carried out when the first difference is less than the first threshold, which can prevent the transportation from being destabilized by the operation to add the adjustment value even when the first difference is small.

In this invention, the control unit may regard as the specific condition a state where an absolute value of a difference between the first detection value and the second detection value is within a second threshold.

When the operation to add the adjustment value to the downstream drive roller is carried out in a state where the absolute value of the difference between the first detection value and the second detection value is larger than the second threshold, the upstream drive roller or downstream drive roller or both the upstream drive roller and downstream drive roller may be damaged, or the medium may be damaged due to an excessive difference in applied tension between the upstream drive roller and downstream drive roller. Such damage can be prevented by carrying out the operation to add the adjustment value to the downstream drive roller only in a state of the absolute value of the difference between the first detection value and the second detection value being equal to or less than the second threshold, or only when the difference in applied tension between the upstream drive roller and downstream drive roller is within a certain range.

In another aspect of this invention, there is provided A printing apparatus for performing printing while transporting an elongate printing medium in a predetermined direction, comprising: a printing station for printing on the printing medium in a printing area disposed along a transport path of the printing medium; an upstream drive roller for transporting the printing medium in a position downstream in the predetermined direction of the printing area; a an upstream tension sensor for detecting tension of the printing medium in a position upstream in the predetermined direction of the printing area; a downstream drive roller for transporting the printing medium in a position downstream in the predetermined direction of the upstream drive roller; a downstream tension sensor for detecting tension of the printing medium in a position between the upstream drive roller and the downstream drive rollers; and a control unit for controlling printing by the printing station while controlling transportation of the printing medium by operating the upstream drive roller based on a first difference which is a difference between a first detection value obtained from the upstream tension sensor and a target value of tension which should be applied to the printing medium, operating the upstream drive roller based on a second difference which is a difference between a second detection value obtained from the upstream tension sensor and a target value of tension which should be applied to the printing medium, and when a specific condition is satisfied, further operating the second driver roller with an adjustment value, which is based on the first difference, added to the second difference.

According to this embodiment, the control unit operates the upstream drive roller based on the first difference, and the downstream drive roller based on the second difference. When the specific condition is satisfied, the control unit operates the downstream drive roller with the adjustment value, which is based on the first difference, added to the second difference. Therefore, a shortage of tension upstream of the printing area is compensated for with an increase by the adjustment value of the control amount for the downstream drive roller. As a result, the tension in the printing area can be made proper, and print quality for the printing medium by the printing station can be improved. Since the first detection value can be brought close to the target value, it can prevent an increase in rotating speed of the upstream drive roller in an effort to continue raising the tension applied to the printing medium, thereby to inhibit damage to the printing medium caused by the upstream drive roller.

BRIEF DESCRIPTION OF THE DRAWINGS

For the purpose of illustrating the invention, there are shown in the drawings several forms which are presently preferred, it being understood, however, that the invention is not limited to the precise arrangement and instrumentalities shown.

DESCRIPTION OF THE PREFERRED EMBODIMENTS

An embodiment of this invention will be described hereinafter with reference to the drawings.

Figure 1:
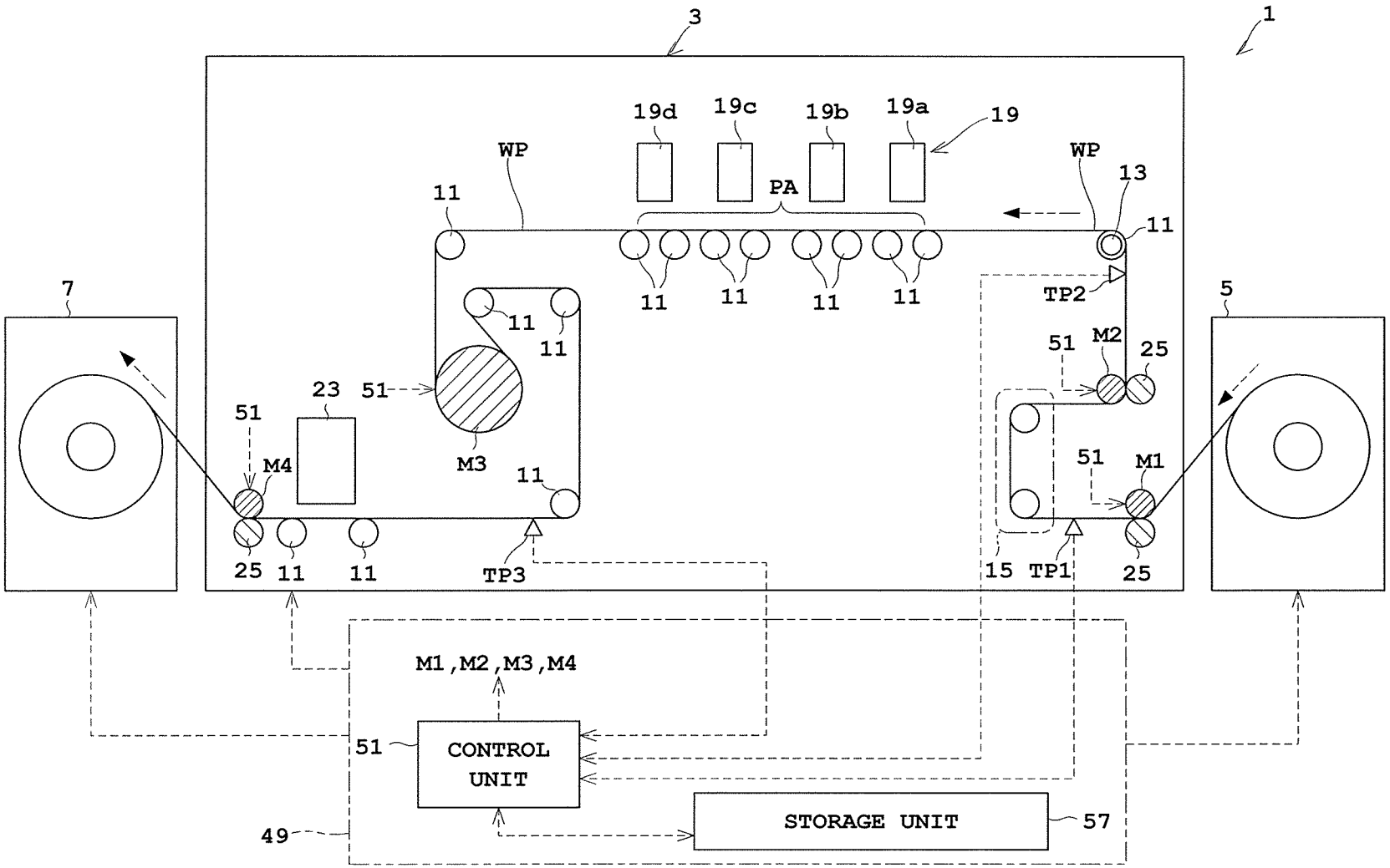
FIG. 1 is a schematic view showing an entire inkjet printing system having a transport apparatus according to this invention.

FIG. 1 is a schematic view showing an entire inkjet printing system having a transport apparatus according to this invention.

An inkjet printing system 1 according to this invention includes an inkjet printing apparatus 3, a paper feeder 5 and a takeup roller 7.

The inkjet printing apparatus 3 performs printing on elongate web paper WP. The paper feeder 5 holds a roll of web paper WP to be rotatable about a horizontal axis, and unwinds the web paper WP from the roll of web paper WP to feed it to the inkjet printing apparatus 3. The takeup roller 7 winds up the web paper WP printed by the inkjet printing apparatus 3 about a horizontal axis. Regarding the side from which the web paper WP is fed as upstream and the side to which the web paper WP is discharged as downstream, the paper feeder 5 is disposed upstream of the inkjet printing apparatus 3 while the takeup roller 7 is disposed downstream of the inkjet printing apparatus 3.

The inkjet printing apparatus 3 corresponds to the "printing apparatus" in this invention. The web paper WP corresponds to the "printing medium" and the "medium" in this invention.

The inkjet printing apparatus 3 includes a first drive roller M1 in an upstream position thereof for taking in the web paper WP from the paper feeder 5. The web paper WP unwound from the paper feeder 5 by the first drive roller M1 is transported downstream toward the takeup roller 7 along a plurality of rotatable transport rollers 11.

An edge position controller 15 is disposed downstream of the first drive roller M1. When the web paper WP wanders off in directions perpendicular to a transport direction, the edge position controller 15 will automatically adjust and control the web paper WP to be transported to a right position.

A second drive roller M2 is disposed downstream of the edge position controller 15. The web paper WP fed downstream by the second drive roller M2 has the transport direction changed by a transport roller 11 disposed downstream of the second drive roller M2, to advance along a transport path to a printing area PA where printing is done. This transport roller 11 has a rotary encoder 13 mounted thereon. The printing area PA has a plurality of transport rollers 11 arranged along the transport path of the web paper WP. A printing station 19 is disposed above the printing area PA. The printing station 19 includes four inkjet heads 19*a*-19*d*, for example. The inkjet head 19*a* in the most upstream position, for example, dispenses ink droplets of black (K), the next inkjet head 19*b* ink droplets of cyan (C), the next inkjet head 19*c* ink droplets of magenta (M), and the next inkjet head 19*d* ink droplets of yellow (Y). The inkjet heads 19*a*-19*d* are arranged separately at predetermined intervals in the transport direction.

The web paper WP printed in the printing area PA has the transport direction changed by a downstream transport roller 11. A third drive roller M3 is disposed ahead. The third drive roller M3 winds the web paper WP at a large winding angle, and contacts the web paper WP to dry the ink droplets on the web paper WP. This third drive roller M3 has a built-in heater, and is also called a heat drum.

The web paper WP dried by the third drive roller M3 is sent by a fourth roller M4 to the takeup roller 7, while having its direction changed by a plurality of transport rollers 11. An inspecting unit 23 is disposed upstream of the fourth drive roller M4. The inspecting unit 23 inspects the web paper WP printed at the printing station 19. The takeup roller 7 takes up in a roll form the web paper WP inspected by the inspecting unit 23.

The first drive roller M1, second drive roller M2 and fourth roller M4 described above individually have nip rollers 25 rotatably attached. A carrying force to the web paper WP is applied by the nip roller 25 pinching the web paper WP with each drive roller. The pressing force of each nip roller 25 is applied by an air cylinder (not shown), for example. The nip rollers 25 are formed of an elastic material such as rubber, for example.

A first tension sensor TP1 is disposed downstream of the first drive roller M1 and upstream of the edge position controller 15. A second tension sensor TP2 is disposed downstream of the second drive roller M2 and upstream of the printing area PA. A third tension sensor TP3 is disposed downstream of the third drive roller M3 and upstream of the fourth drive roller M4. The first to third tension sensors TP1-TP3 successively detect current tension applied to the web paper WP, and output detection values of the tension.

The inkjet printing apparatus 3, paper feeder 5 and takeup roller 7 are operable under overall control of a main controller 49. The main controller 49 includes a control unit 51 constructed of a CPU and other components. The control unit 51 controls transportation by giving the above-described first to fourth drive rollers M1-M4 control amounts as described in detail hereinafter. The control is carried out to realize transport speeds corresponding to printing conditions set beforehand by the operator. The control unit 51 determines transport speeds and transport distances based on output signals of the rotary encoder 13. The printing conditions are conditions relating to print quality, such as transport speeds of the web paper WP and each target value of the tension in each part applied to the web paper WP, for example. A storage unit 57 stores beforehand thresholds to be described hereinafter.

Figure 2:
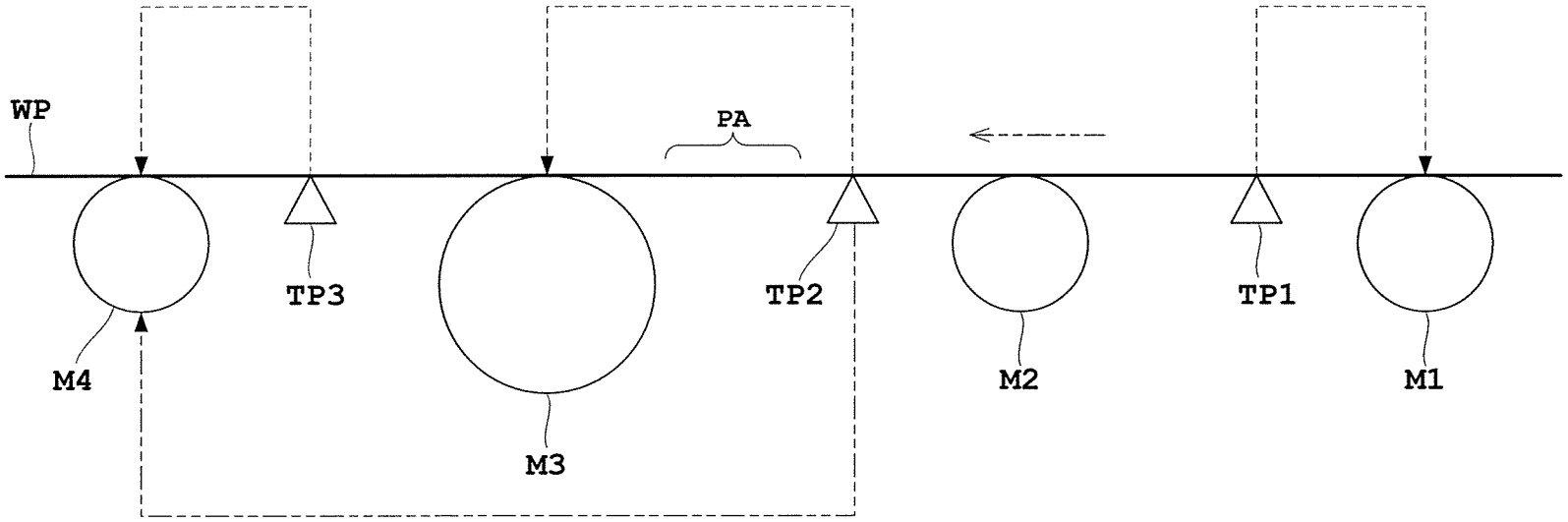
FIG. 2 is a schematic view showing a control relationship of a first to a fourth drive rollers.

Reference is now made to FIG. 2. FIG. 2 is a schematic view showing a control relationship of the first to fourth drive rollers.

The control unit 51, based on a difference between a target value of tension which should be applied to the web paper W in the location of the first tension sensor TP1 and a detection value of the first tension sensor TP1, gives a control amount to the first drive roller M1 to make the detection value equal to the target value. The control unit 51, based on a difference (corresponding to the first difference) between a target value of tension which should be applied to the web paper W in the location of the second tension sensor TP2 and a detection value of the second tension sensor TP2, gives a control amount to the third drive roller M3 to make the detection value equal to the target value. Similarly, the control unit 51, based on a difference (corresponding to the second difference) between a target value of tension which should be applied to the web paper WP in the location of the third tension sensor TP3 and a detection value of the third tension sensor TP3, gives a control amount to the fourth drive roller M4 to make the detection value equal to the target value. The above three controls are performed repeatedly in relatively short cycles (e.g. 1 msec~1000 msec, preferably 20 msec~50 msec) by the control unit 51.

Further, the control unit 51, when it is determined that the specific conditions described hereinafter have been satisfied, performs control by adding to the above control amount for the fourth drive roller M4 an adjustment value based on the difference between the target value of tension which should be applied to the web paper W in the location of the second tension sensor TP2 and the detection value of the second tension sensor TP2. This additional control is performed repeatedly in relatively 1 ng cycles (e.g. 1 sec~12 sec, 60~6000 times of the short cycles) by the control unit 51.

The third drive roller M3 described above corresponds to the "upstream drive roller" in this invention. The fourth drive roller M4 corresponds to the "downstream drive roller" in this invention. The second tension sensor TP2 described above corresponds to the "upstream tension sensor" in this invention. The third tension sensor TP3 corresponds to the "downstream tension sensor" in this invention.

Figure 3:
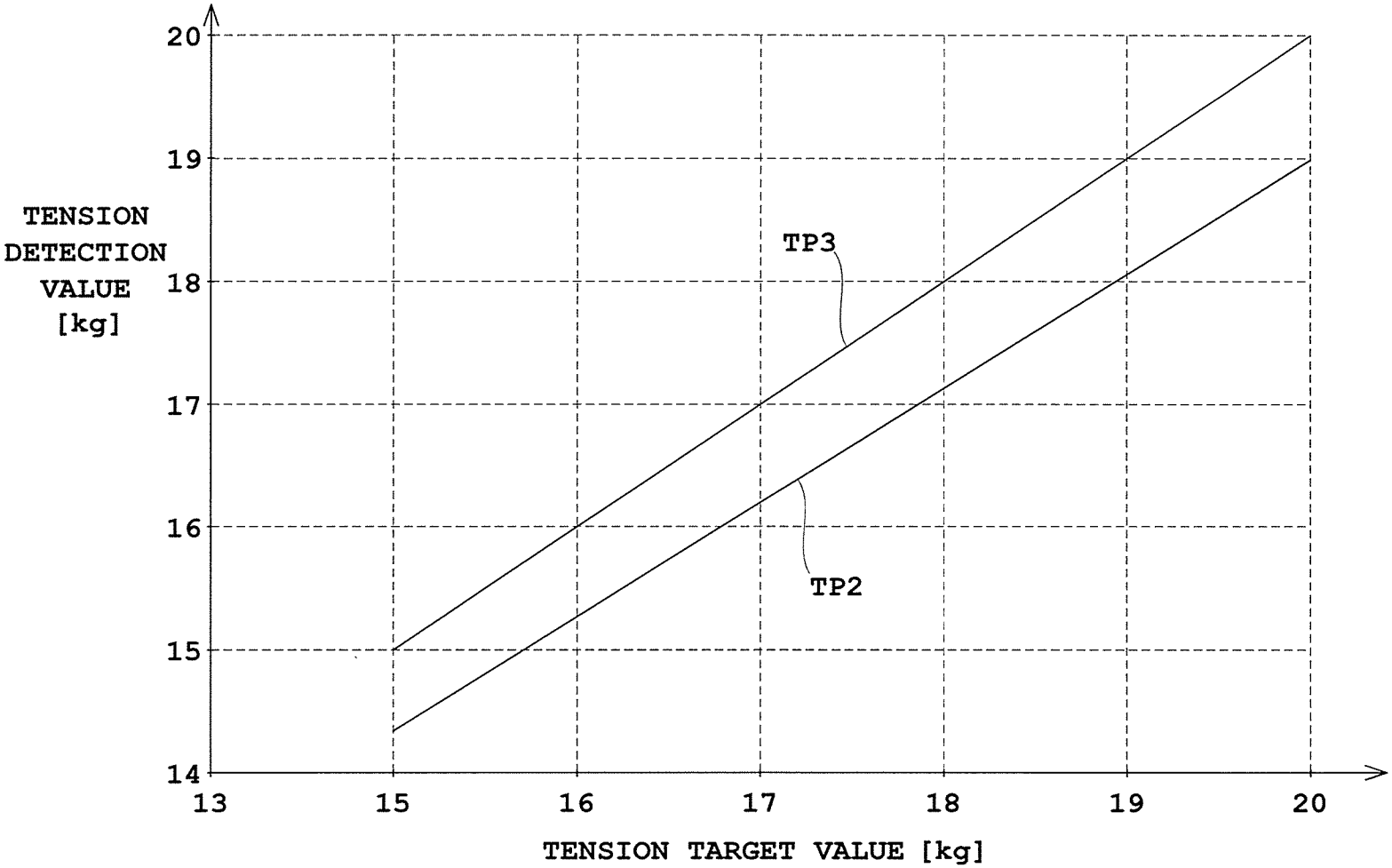
FIG. 3 is a graph showing a relationship between detection values of a second and a third tension sensors when a target value for the third tension sensor is increased.

Reference is now made to FIG. 3. FIG. 3 is a graph showing a relationship between detection values of the second and third tension sensors when the target value for the third tension sensor is increased.

As noted above, when the specific conditions have been satisfied, an adjustment value based on the difference between the target value of tension which should be applied to the web paper WP in the location of the second tension sensor TP2 and the detection value of the second tension sensor TP2 is added to the control amount for the fourth drive roller M4. This means that, by increasing the control amount for the fourth drive roller M4, the tension at the second tension sensor TP2 disposed upstream thereof is increased. So, Inventors herein carried out an experiment beforehand on how the tension at the second tension sensor TP2 changes when the speed of the fourth drive roller M4 is increased by gradually raising the target value for the third tension sensor TP3. The result is the graph in FIG. 3. It will be seen that, when the fourth drive roller M4 is operated to increase the tension at the third tension sensor TP3, the tension at the second tension sensor TP2 can be increased without increasing the control amount for the third drive roller M3.

Figure 4:
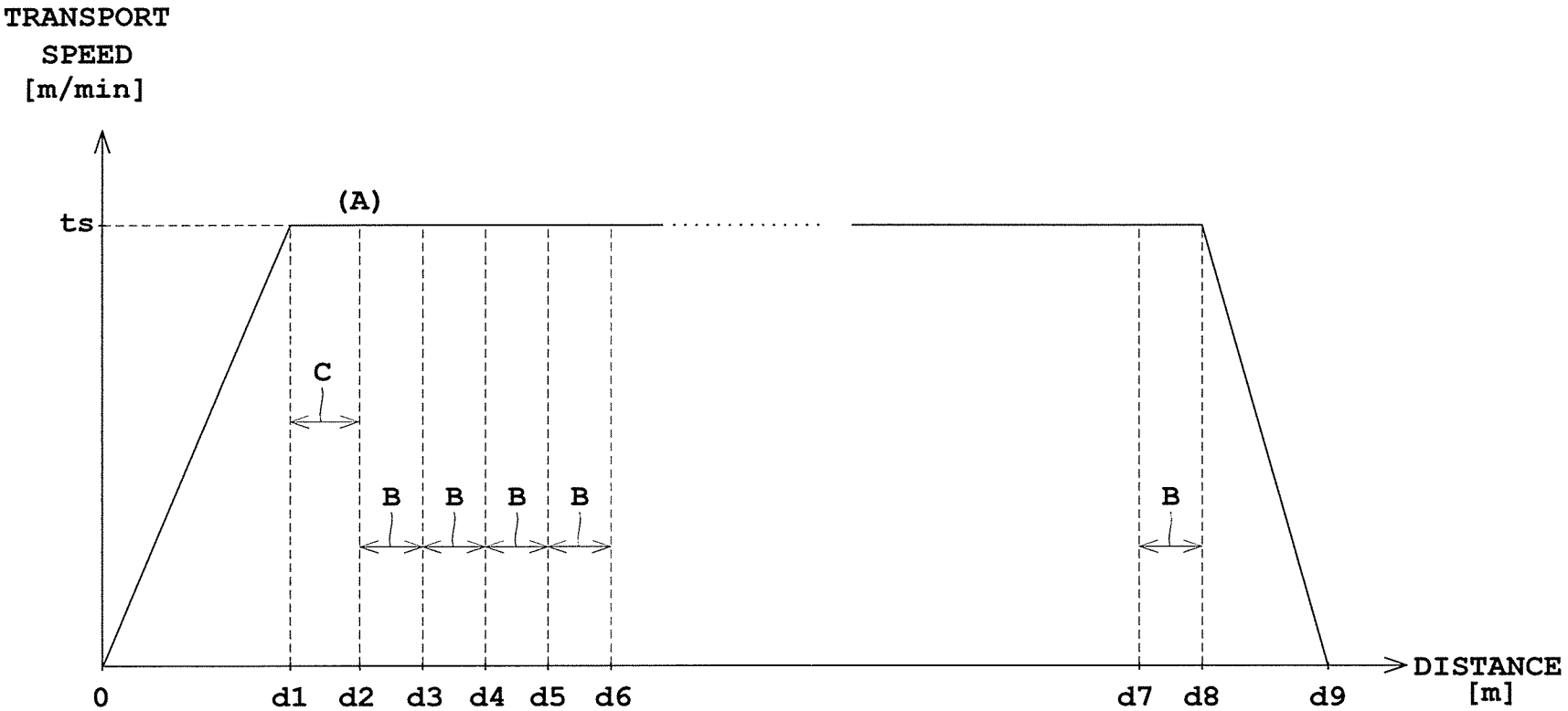
FIG. 4 is a time chart showing an example of control of transport speed.

Next, reference is made to FIG. 4. FIG. 4 is a time chart showing an example of control of transport speed.

The control unit 51 noted above operates the first to fourth drive rollers M1-M4 to control transportation of the web paper WP as shown in FIG. 4, for example. That is, acceleration is started at time 0 to attain transport speed ts at the time of transportation at distance d1, which is followed by constant transportation at transport speed ts until time d8, and deceleration started at time d8 to reduce the transport speed ts to zero at time d9.

The control unit 51 checks whether the specific conditions described hereinafter are satisfied or not, at time A (at time d2) when a substantially stabilized transportation at transport speed ts is started at a predetermined distance C from the point of time the acceleration of the web paper WP is completed. This is because the detection value of tension often varies greatly during the acceleration and immediately after the end of acceleration, which makes it impossible to determine accurately whether the specific conditions are satisfied or not. Therefore, since whether the specific conditions are satisfied or not can be determined accurately after the transport speed is becomes constant, which enables the control with an adjustment value added of the fourth drive roller M4 to be carried out appropriately.

The control unit 51 checks at the end of every transportation over a predetermined transport distance B (e.g. 10*m*) whether the specific conditions are satisfied or not. This is done to avoid an inconvenience that the transportation of the web paper WP may become unstable when the control unit 51 frequently checks whether the specific conditions are satisfied, and frequently performs the control of the fourth drive roller M4 to which an adjustment value is added. This can also lighten the load on the control unit 51.

One of the specific conditions noted above is that the difference (corresponding to the "first difference") between the target value of tension which should be applied by the third drive roller M3 and the detection value of the second tension sensor TP2 which detects the tension corresponding to the tension applied to the printing area PA by the third drive roller M3 becomes a predetermined threshold Tmin or higher. The predetermined threshold Tmin corresponds to the "first threshold" in this invention. The operation to add the adjustment value is not carried out when this first difference is less than the predetermined threshold Tmin, which can prevent the transportation from being destabilized by the operation to add the adjustment value even when the first difference is small.

Another of the specific conditions is that an absolute value of a difference between the detection value of the second tension sensor TP2 and the detection value of the third tension sensor TP3 becomes a predetermined threshold Tmax (e.g. 5000 g) or less. The predetermined threshold Tmax corresponds to the "second threshold" in this invention.

When the operation to add the adjustment value to the fourth drive roller M4 is carried out in a state where the absolute value of the difference between the detection value of the second tension sensor TP2 and the detection value of the third tension sensor TP3 is larger than the predetermined threshold Tmax, the third drive roller M3 or fourth drive roller M4 or both the third drive roller M3 and fourth drive roller M4 may be damaged, or the web paper WP may be damaged due to an excessive difference in applied tension between the third drive roller M3 and fourth drive roller M4. Such damage can be prevented by carrying out the operation to add the adjustment value to the fourth drive roller M4 only in a state of that absolute value being equal to or less than the predetermined threshold Tmax, or only when the difference in applied tension between the third drive roller M3 and fourth drive roller M4 is within a certain range.

The above third drive roller M3, second tension sensor TP2, fourth drive roller M4, third tension sensor TP3 and control unit 51 correspond to the "transport apparatus" in this invention.

Figure 5:
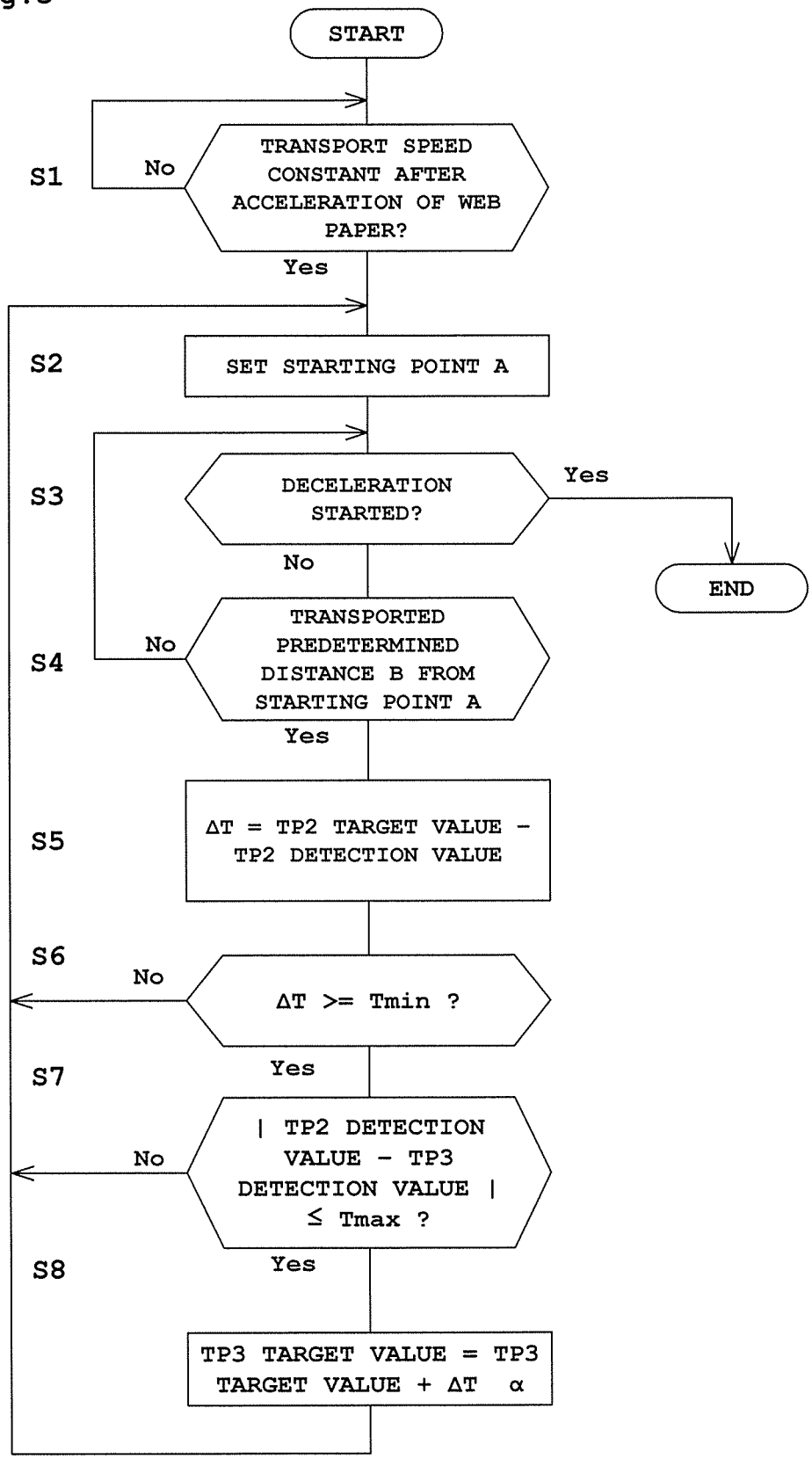
FIG. 5 is a flow chart showing an example of control.

Next, an example of control in transporting the web paper WP in the above inkjet printing apparatus 3 will be described with reference to FIG. 5. FIG. 5 is a flow chart showing the example of control.

Step S1

The control unit 51 repeatedly performs this checking process until elapse of time d2 in FIG. 4. When the tension stabilizes immediately after the end of the acceleration, it is not necessary to wait for completion of the predetermined distance C.

Step S2

The control unit 51 sets starting point A to 0.

Step S3

The control unit 51 branches the process according to whether the deceleration as from time d8 in FIG. 4 has started. That is, the process is ended when the deceleration has started, and when the deceleration has not started, the process is branched to step S4.

Step S4

The control unit 51 repeats branching to step S3 while the transportation of the web paper WP continues from the starting point A to the end of the predetermined distances B. When the predetermined distances B have been covered, the process moves to step S5.

Steps S5 and S6

The control unit 51 calculates the first difference. Specifically, the control unit 51 determines difference ΔT (first difference) between the target value of tension which should be applied by the third drive roller M3 and the detection value of the second tension sensor TP2 which detects tension corresponding to the tension applied to the printing area PA by the third drive roller M3, and branches the process according to whether or not the difference ΔT is equal to or larger than the predetermined threshold Tmin. When the difference ΔT is equal to or larger than the predetermined threshold Tmin, the specific condition is satisfied and the process branches to step S7. When the difference ΔT is less than the predetermined threshold Tmin, the specific condition is not satisfied and the process branches to step S2.

Step S7

The control unit 51 checks whether the absolute value of the difference between the detection value of the second tension sensor TP2 and the detection value of the third tension sensor TP3 satisfies the specific condition of being equal to or less than the predetermined threshold Tmax. When the absolute value of the difference satisfies the specific condition of being equal to or less than the predetermined threshold Tmax, the process moves to step S8. When the absolute value of the difference does not satisfy the specific condition of being equal to or less than the predetermined threshold Tmax, the process branches to step S2.

Step S8

The control unit 51 adds the adjustment value, which is difference ΔT multiplied by coefficient α (e.g. 70%), to the original target value of tension which should be applied by the fourth drive roller M4, to make a new target value of tension which should be applied by the fourth drive roller M4. And the control unit 51 operates the fourth drive roller M4 based on the new target value.

According to this embodiment, when the specific conditions are satisfied, the control unit 51 operates the fourth drive roller M4 by adding the adjustment value based on difference ΔT to the original target value of tension which should be applied by the fourth drive roller M4. Therefore, a shortage of tension upstream of the printing area PA is compensated for with an increase by the adjustment value of the control amount for the fourth drive roller M4. As a result, the tension in the printing area PA can be made proper, and print quality for the web paper WP can be improved. Since the detection value of the second tension sensor TP2 can be brought close to the target value, it can prevent an increase in rotating speed of the third drive roller M3 in an effort to continue raising the tension applied to the web paper WP, thereby to inhibit damage to the web paper WP caused by the third drive roller M3.

Figure 6:
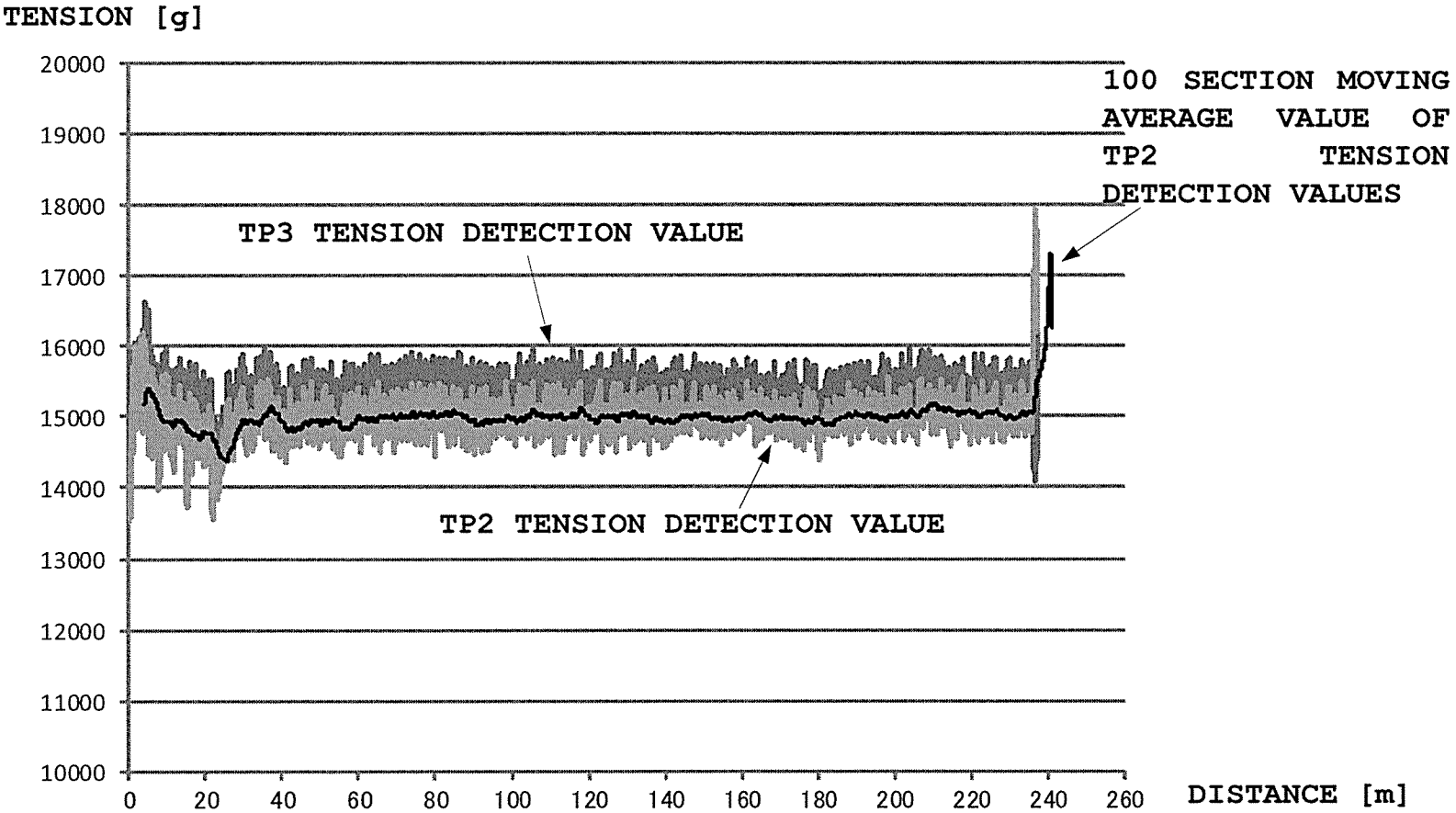
FIG. 6 is a time chart showing variations in detection values of the second and third tension sensors.
Figure 7:
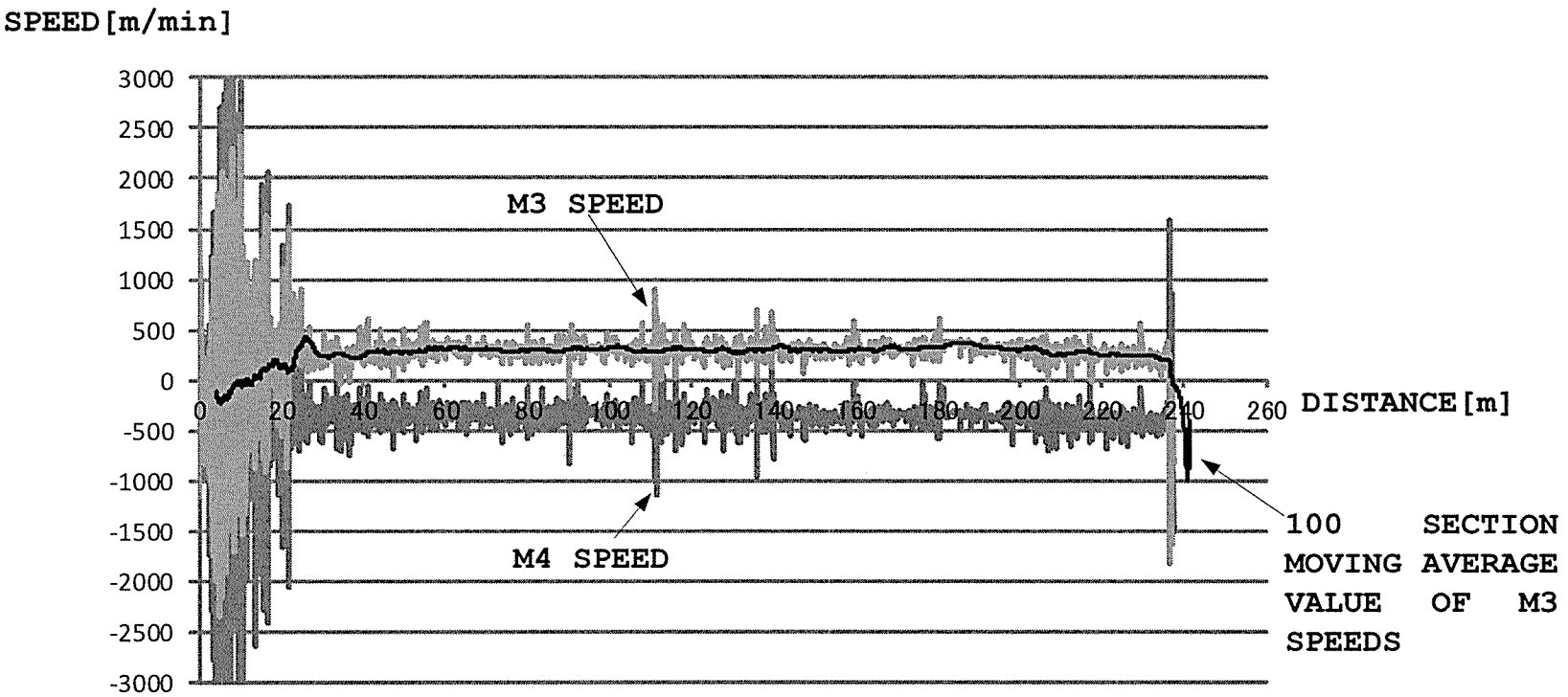
FIG. 7 is a time chart showing variations in speeds of the third and fourth drive rollers.

Next, variations of the tension and speed according to the above embodiment will be described with reference to FIGS. 6 and 7. FIG. 6 is a time chart showing variations in the detection values of the second and third tension sensors. FIG. 7 is a time chart showing variations in the speeds of the third and fourth drive rollers. The printing conditions for collecting the data in these time charts are such that the transport speed of the web paper WP is 50 m/min, and the target value for the second tension sensor TP2 is 15000 [g].

When the above control is carried out with the adjustment value added to the fourth drive roller M4, it will be appreciated that, as shown in FIG. 6, the tension detected by the third tension sensor TP3 rises, and the tension detected by the second tension sensor TP2 also rises. Regarding a 100 section moving average value about the detection values of the second tension sensor TP2, it will also be seen that the detection value of the second tension sensor TP2 substantially corresponds to the target value=15000 [g]. The 100 section moving average value is an average value during 100 cycles time (e.g. 2 sec) of the relatively short cycles.

Further, it will be appreciated that, as shown in FIG. 7, the speed (100 section moving average value) of the third drive roller M3 is very stable in a fixed transport speed range from the end of acceleration to the start of deceleration.

Figure 8:
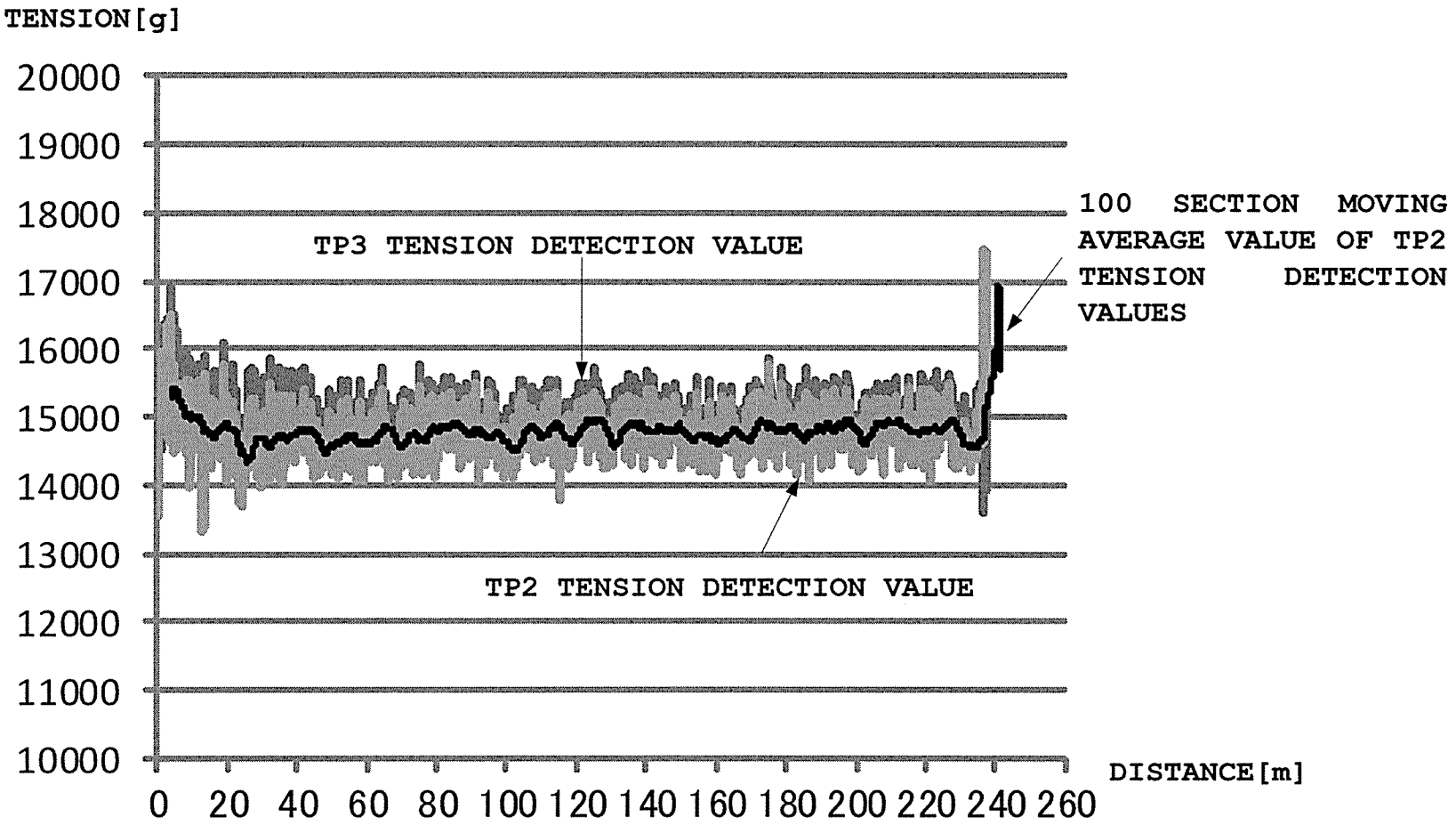
FIG. 8 is a time chart showing variations in detection values of the second and third tension sensors in a conventional example.
Figure 9:
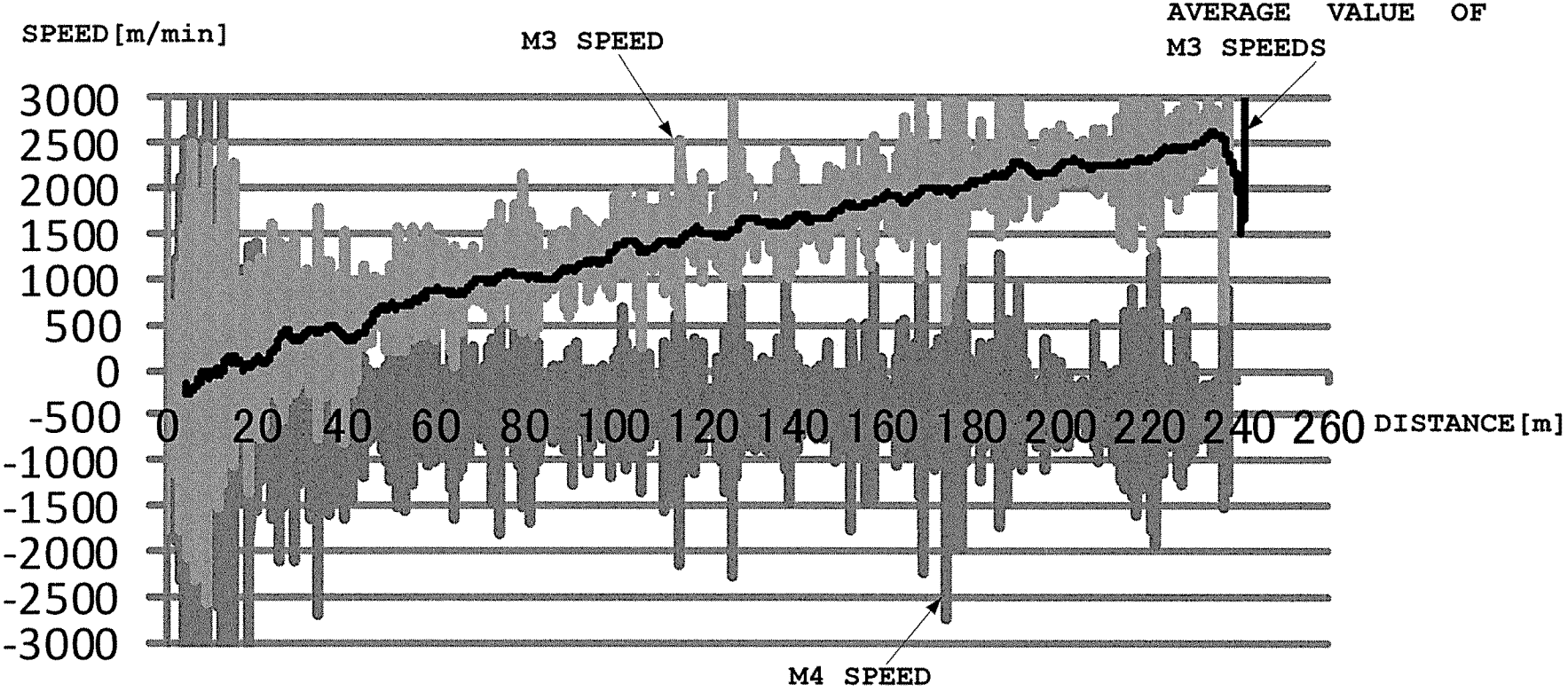
FIG. 9 is a time chart showing variations in speeds of the third and fourth drive rollers in the conventional example.

Next, a conventional example will be described with reference to FIGS. 8 and 9, for comparison with the above embodiment. FIG. 8 is a time chart showing variations in detection values of the second and third tension sensors in the conventional example. FIG. 9 is a time chart showing variations in speeds of the third and fourth drive rollers in the conventional example. The printing conditions for collecting the data in these time charts are the same as in the foregoing embodiment, the only difference lying in that the adjustment value is not applied to the fourth drive roller M4, Since the control which applies the adjustment value to the fourth drive roller M4 is omitted in the conventional example, as shown in FIG. 8, the tension detected by the second tension sensor TP2 does not rise sufficiently, and its variations are large and unstable.

Further, it will be appreciated that, as shown in FIG. 9, the speed (100 section moving average value) of the third drive roller M3 continues increasing and is unstable in the fixed transport speed range from the end of acceleration to the start of deceleration. Thus, since the detection value of tension in the second tension sensor TP2 which greatly influences the print quality in the printing area PA does not reach the target value, the speed of the third drive roller M3 is gradually increased. However, since the detection value of tension in the second tension sensor TP2 does not reach the target value at all, the speed of the third drive roller M3 continues to be increased. As a result, the web paper WP continues slipping relative to the third drive roller M3, which could cause damage to the web paper WP.

This invention is not limited to the foregoing embodiment, but may be modified as follows:

(1) In the foregoing embodiment, the adjustment value is added to the second difference from the target value for the fourth drive roller M4 only when the two specific conditions are satisfied. However, this invention does not necessarily require these two specific conditions to be satisfied. The checking in step S7 described hereinbefore may be omitted when, for example, no problem arises even when a large difference in tension occurs between the third drive roller M3 and fourth drive roller M4.

(2) In the foregoing embodiment, the checking whether the two specific conditions are satisfied is carried out each time the transport distance of the web paper WP attains a predetermined distance. The checking whether the two specific conditions are satisfied may be carried out at short intervals of time if the operation of the fourth drive roller M4 with the adjustment value added does not bring about instability and the load on the control unit 51 is permissible.

(3) The foregoing embodiment has been described taking the inkjet printing apparatus 3 for example. However, this invention is not limited to the inkjet printing apparatus 3. For example, any printing mode will do as long as a printing apparatus performs printing while transporting an elongate printing medium.

(4) The foregoing embodiment has been described taking for example the transport path of the web paper WP constructed as shown in FIG. 1. This invention is not limited to such construction.

(5) The foregoing embodiment has been described taking the web paper WP as an example of printing medium and medium. This invention is not limited to such a printing medium or medium. This invention is applicable also to a printing medium and medium such as film, for example.

This invention may be embodied in other specific forms without departing from the spirit or essential attributes thereof and, accordingly, reference should be made to the appended claims, rather than to the foregoing specification, as indicating the scope of the invention.

What is claimed is:

1. A transport apparatus for transporting an elongate printing medium in a predetermined direction, the transport apparatus comprising:

an upstream drive roller for transporting the printing medium;

an upstream tension sensor for detecting, as a first detection value, tension of the printing medium at a position upstream in the predetermined direction of the upstream drive roller;

a downstream drive roller for transporting the printing medium at a position downstream in the predetermined direction of the upstream drive roller;

a downstream tension sensor for detecting, as a second detection value, tension of the printing medium at a position between the upstream drive roller and the downstream drive roller; and a control unit for controlling transportation of the printing medium by:

operating the upstream drive roller based on a first difference between the first detection value and a first target tension value, the first difference used to set the first detection value to be equal to the first target tension value;

operating the downstream drive roller based on a second difference between the second detection value and a second target tension value, the second difference used to set the second detection value to be equal to the second target tension value applied to the printing medium by the downstream drive roller; and when the first difference is equal to or larger than a first threshold, further operating the downstream drive roller based on a third difference between the second detection value and a third target tension value such that further operating the downstream drive roller compensates a shortage of tension upstream of the upstream drive roller, the third difference used to set the second detection value to be equal to the third target tension value applied to the printing medium by the downstream drive roller, the third target tension value determined based on 1) multiplying the first difference by a coefficient of 1 or less and 2) adding a result of the multiplication to the second target tension value, the second detection value being set to be equal to the third target tension value, the third target tension value being greater than the second target tension value.

2. The transport apparatus according to claim 1, wherein the control unit checks whether the first difference is equal to or larger than the first threshold, after a transport speed of the printing medium has become constant.

3. The transport apparatus according to claim 2, wherein the control unit checks whether the first difference is equal to or larger than the first threshold, each time a transport distance of the printing medium attains a predetermined distance.

4. The transport apparatus according to claim 2, wherein the control unit regards as the specific condition a state where an absolute value of a difference between the first detection value and the second detection value is within a second threshold.

5. The transport apparatus according to claim 3, wherein the control unit regards as the specific condition a state where an absolute value of a difference between the first detection value and the second detection value is within a second threshold.

6. A printing apparatus for performing printing while transporting an elongate printing medium in a predetermined direction, comprising:

a printing station for printing on the printing medium at a printing area disposed along a transport path of the printing medium;

an upstream drive roller for transporting the printing medium in a position downstream in the predetermined direction of the printing area;

an upstream tension sensor for detecting, as a first detection value, tension of the printing medium in a position upstream at the predetermined direction of the printing area;

a downstream drive roller for transporting the printing medium at a position downstream in the predetermined direction of the upstream drive roller;

a downstream tension sensor for detecting, as a second detection value, tension of the printing medium at a position between the upstream drive roller and the downstream drive rollers; and a control unit for controlling printing by the printing station while controlling transportation of the printing medium by:

operating the upstream drive roller based on a first difference between the first detection value and a first target tension value, the first difference used to set a first detection value to be equal to the first target tension value;

operating the downstream drive roller based on a second difference between the second detection value and a second target tension value, the second difference used to set the second detection value to be equal to the second target tension value; and when the first difference is equal to or larger than a first threshold, further operating the second drive roller based on a third difference between the second detection value and a third target tension value such that further operating the downstream drive roller compensates a shortage of tension upstream of the upstream drive roller, the third difference used to set the second detection value to be equal to the third target tension value applied to the printing medium by the downstream drive roller, the third target tension value determined based on 1) multiplying the first difference by a coefficient of 1 or less and 2) adding a result of the multiplication to the second target tension value, the second detection value set to be equal to the third target tension value the third target value being greater than the second target value.

7. The printing apparatus according to claim 6, wherein the control unit checks whether the first difference is equal to or larger than a first threshold, after a transport speed of the printing medium has become constant.

8. The printing apparatus according to claim 7, wherein the control unit checks whether the first difference is equal to or larger than a first threshold, each time a transport distance of the printing medium attains a predetermined distance.

9. The printing apparatus according to claim 7, wherein the control unit regards as the specific condition a state where an absolute value of a difference between the first detection value and the second detection value is within a second threshold.

10. The printing apparatus according to claim 8, wherein the control unit regards as the specific condition a state where an absolute value of a difference between the first detection value and the second detection value is within a second threshold.

11. The printing apparatus according to claim 6, wherein the printing station prints on the printing medium by dispensing ink droplets thereto.

12. The printing apparatus according to claim 7, wherein the printing station prints on the printing medium by dispensing ink droplets thereto.

13. The transport apparatus according to claim 1, further comprising a nip roller for applying a pressing force to the medium, and wherein the downstream drive roller transports the medium in cooperation with the nip roller.

14. The transport apparatus according to claim 1, wherein the upstream drive roller is a heat drum.

15. The printing apparatus according to claim 6, further comprising a nip roller for applying a pressing force to the medium, and wherein the downstream drive roller transports the medium in cooperation with the nip roller.

16. The printing apparatus according to claim 6, wherein the upstream drive roller is heat drum.

17. The transport apparatus according to claim 1, wherein the coefficient is 0.7 or less.

18. The printing apparatus according to claim 6, wherein the coefficient is 0.7 or less.

* * * * *